US006413634B1

(12) United States Patent
Tanaka et al.

(10) Patent No.: US 6,413,634 B1
(45) Date of Patent: Jul. 2, 2002

(54) ELECTRICALLY-CONDUCTIVE COMPOSITE FIBER

(75) Inventors: Kazuhiko Tanaka; Akihiro Hokimoto; Yoshiteru Matsuo; Masao Kawamoto, all of Okayama-Pref. (JP)

(73) Assignee: Kuraray Co., Ltd., Kurashiki (JP)

( * ) Notice: Subject to any disclaimer, the term of this patent is extended or adjusted under 35 U.S.C. 154(b) by 7 days.

(21) Appl. No.: 09/680,537

(22) Filed: Oct. 6, 2000

(30) Foreign Application Priority Data

Oct. 6, 1999 (JP) ..... 11-285464

(51) Int. Cl.[7] ..... D01F 8/00

(52) U.S. Cl. ..... 428/370; 428/373; 428/374; 428/372

(58) Field of Search ..... 428/370, 373, 428/374, 395, 372

(56) References Cited

U.S. PATENT DOCUMENTS 5,153,066 A * 10/1992 Tanaka et al. ..... 428/373
5,318,845 A * 6/1994 Tanaka et al. ..... 428/372
5,464,695 A * 11/1995 Kawamoto ..... 428/370

FOREIGN PATENT DOCUMENTS

JP 2001049532 A * 2/2001
JP 2001049534 A * 2/2001

* cited by examiner

*Primary Examiner*—N. Edwards
(74) *Attorney, Agent, or Firm*—Oblon, Spivak, McClelland, Maier & Neustadt, P.C.

(57) ABSTRACT

An electrically-conductive composite fiber composed of an electrically-conductive polyamide layer (A) containing 15–50 wt % of electrically-conductive carbon black and which is three or more times exposed at the fiber surface and a protective polyamide layer (B) which covers no less than 60% of the periphery of the fiber cross section and accounts for 50–97 wt % of the total fiber weight, does not exhibit component separation during spinning, retains its good initial conductive performance for a long period of time, and exhibits good color fastness.

8 Claims, 3 Drawing Sheets

ELECTRICALLY-CONDUCTIVE COMPOSITE FIBER

BACKGROUND OF THE INVENTION

1. Field of the Invention

The present invention relates to a composite fiber having a low content of electrically conductive carbon black and having good destaticizing performance over a long period of time. This composite fiber suppresses dusting, maintains excellent conducting performance over a long period of time, and can be mixed or woven with other fibers to give garments having good ironing resistance and good color fastness. When used as a charging brush for copying machines and printers the composite fiber allows for the production of high-quality printed images over a long period of time.

2. Discussion of the Background

A variety of electrically-conductive fibers with good destaticizing properties have been proposed. For example, electrical conductivity is introduced by metallic plating on the surface of a non-conducting fiber or by formation of an electrically-conductive coating layer on a fiber from resin or rubber in which electrically-conductive carbon black is incorporated. Drawbacks are their complex and difficult production processes or their easy loss of electrical conductivity during scouring, involving chemical treatment, and in actual use, involving wearing and repeated washing.

Another example of an electrically-conductive fiber is a metallic fiber, such as steel fiber. Although such metallic fiber is known for its good destaticizing properties, it is expensive and incompatible with ordinary organic matters. This causes troubles in weaving and dying steps. Moreover, it easily breaks and drops during washing. Its electrical conductivity gives an unpleasant feel and causes sparking and cloth melting.

A further example of an electrically-conductive fiber is produced from a polymer containing uniformly dispersed electrically-conductive carbon black. A disadvantage of this type of fiber is its difficult production process due to a large content of electrically-conductive carbon black. The yields are poor and the production costs are high. Its fiber properties are poor and it can only be produced with difficulties by a special process.

New ideas have been proposed in order to address the above problems. For example, U.S. Pat. No. 3,803,453 discloses a composite fiber of sheath-core type in which the core polymer contains an electrically-conductive carbon black and the sheath is made of an ordinary fiber-forming polymer. It is limited in its core size (smaller than 50%) so that it exhibits necessary fiber properties. This leads to a thick sheath, which is non-conductive, and a core highly filled with carbon black.

Japanese Patent Publication No. 44579/1978 attempts to solve the problem of the above U.S. patent. It discloses an electrically-conductive composite fiber in which the core contains electrically-conductive carbon black and is only partly covered by a sheath. However, it has poor chemical resistance and durability and core-sheath separation occurs because the core is not completely covered by the sheath.

Further, Japanese Patent Laid-open No. 152513/1977 discloses a composite fiber of side-by-side configuration which is composed of a layer of electrically-conductive polymer containing an electrically-conductive carbon black and a layer of non-conductive polymer containing no carbon black. The two polymers are of the same type. This electrically-conductive fiber has also poor chemical resistance and durability because the layer containing the electrically-conductive carbon black is exposed at the surface.

On the other hand, Japanese Patent Laid-open Nos. 147865/1978 and 34470/1979 disclose an electrically conductive fiber which is composed of a fiber-forming polymer and a linear polymer containing a streakily dispersed organic electrically-conductive substance. This fiber is less sensitive to peeling and surface wearing and has improved washing durability because its electrically-conductive component is enclosed in the fiber.

The disadvantage of this fiber is low strength because the linear polymer containing the organic electrically-conductive substance is dispersed and mixed discontinuously in the longitudinal direction of the fiber-forming polymer. The linear electrically-conductive polymer has no contribution to fiber strength and is completely incompatible with the linear polymer. In addition, the electrical conductivity of this fiber fluctuates depending on the dispersion of the electrically-conductive polymer. Therefore, it is difficult to control manufacturing conditions and product quality. In the case where a polymer is mixed with and dispersed in an incompatible polymer, the dispersed component is not completely enclosed in the matrix component, but is partly exposed at the surface. Therefore, the dispersed component, namely the electrically-conductive polymer, will partly drop off. In addition, the productivity of the production process of this fiber is poor because it suffers excessively large ballooning which stains spinnerets and causes fiber breakage.

Other electrically-conductive composite fibers are disclosed in Japanese Patent Laid-open Nos. 134117/1979, 132624/1986, and 279416/1997. They are constructed such that the electrically-conductive polymer layer partly is exposed at the fiber surface. They wear only a little by friction with metal in fiber production and fiber processing. The constituent components do not separate from each other and the electrically-conductive component does not drop off.

The conventional electrically-conductive composite fiber composed of an electrically-conductive polymer layer and a non-electrically-conductive polymer layer poses no problems during production. However, one disadvantage of this fiber is the decrease in conductivity due to peeling after prolonged use. The electrically-conductive composite fiber is usually mixed with an ordinary fiber when it is used for garments, such as uniforms. Such mixed fabrics are not satisfactory when dyed because of the poor color fastness of the electrically-conductive fiber.

In the conventional technology of electrically-conductive fiber for garment use, no attention has been paid to the long-term durability of conductivity, peel resistance of constituent components, and performance in use.

In addition, there has not been any electrically-conductive composite fiber for non-garment applications which exhibits stable conductivity that is not affected by temperature or environment, has a low starting voltage, good destaticizing performance at a high applied voltage, very little decrease in destaticizing performance after prolonged use, and ability to produce sharp images continuously over a long period of time when used in printers.

SUMMARY OF THE INVENTION

It is an object of the present invention to provide an electrically-conductive composite fiber which is not sensitive to wear or component separation during its production or its processing into fabrics, but keeps its good initial performance even after prolonged use in a fabric.

It is another object of the present invention to provide an electrically-conductive composite fiber which when mixed with another fiber and subsequently dyed exhibits such good color fastness that no color migration to the other fiber occurs.

These and other objects are achieved according to the invention, the first embodiment of which includes an electrically-conductive composite fiber, comprising:

(A) an electrically-conductive polymer layer; and (B) a protective polymer layer.

Another embodiment of the invention includes a charging brush or a destaticizing brush for a printer or a copying machine, comprising:

(A) an electrically-conductive polymer layer; and (B) a protective polymer layer.

DESCRIPTION OF THE PREFERRED EMBODIMENTS

Figure 1:
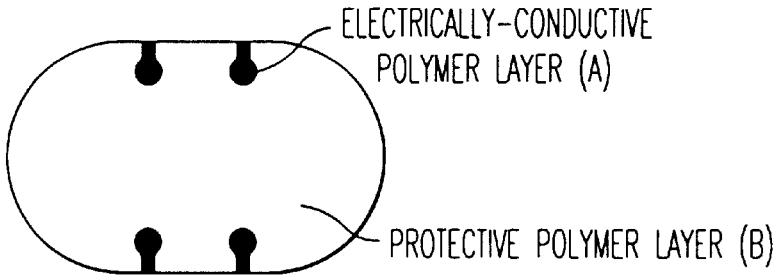
FIG. 1 is a sectional view showing a first configuration of the electrically-conductive composite fiber according to the present invention.

The present invention is directed to an electrically-conductive composite fiber comprising an electrically-conductive polymer layer (A) made of a thermoplastic polyamide containing 15–50 wt % of electrically-conductive carbon black and a protective polymer layer (B) made of a thermoplastic polyamide having a melting point not lower than 170° C. The electrically-conductive polymer layer (A) is exposed at three or more places on the fiber surface along the periphery of an arbitrary cross section, such that the length $L_1$ (in $\mu$m) of one exposed part satisfies expression (1)

$$0.1 \leq L_1 \leq L_2/10 \quad (1)$$

where $L_2$ stands for the length (in $\mu$m) of the periphery of a cross section of one filament. The protective polymer layer (B) covers no less than 60% of the periphery of the fiber cross section and accounts for 50–97 wt % of the total fiber weight. The thermoplastic polyamide constituting the protective polymer layer (B) is synthesized from a dicarboxylic acid component and a diamine component. The term "wt %" is used herein having the meaning of "% by weight" or "weight %".

In above dicarboxylic acid an aromatic dicarboxylic acid accounts for no less than 60 mol % based on the total amount of dicarboxylic acid.

In above diamine a $C_{6-12}$ aliphatic alkylenediamine accounts for no less than 60 mol % based on the total amount of diamine.

In a preferred embodiment of the present invention, the electrically-conductive layer (A) contains at least two kinds of electrically-conductive carbon black differing in oil absorption such that the ratio of the oil absorption of the first electrically-conductive carbon black to the oil absorption, of the second electrically-conductive carbon black is from 1.2 to 25. Further, the electrically-conductive layer (A) has an electrical resistance R (Ω/cm·f) for an applied voltage of 100V, wherein log R is from 7.0 to 11.9

The electrically-conductive composite fiber of the present invention can be used for garments, such as uniforms, as well as charging brushes and/or destaticizing brushes built into printers and copying machines.

According to the present invention, the electrically-conductive polymer layer (A) contains electrically-conductive carbon black in an amount of 15–50 wt %, preferably 20–40 wt % and more preferably 25–35% based on the total weight of component (A). The amount of electrically conductive carbon black includes all values and subvalues therebetween, especially including 20, 25, 30, 35, 40 and 45 wt % based on the total weight of component (A).

Less than 15 wt % of the electrically-conductive carbon black do not produce the desired conductivity and the electrically-conductive composite fiber does not exhibit satisfactory destaticizing performance. With a content in excess of 50 wt % the effect of the electrically-conductive carbon black levels off and the polymer constituting the core has extremely poor fluidity and spinnability.

It is preferred for the electrically-conductive carbon black to have a structure, for example, a chain-like structure of particles, so that it exhibits good electrical conductivity. However, carbon black composed of dispersed particles is poor in electrical conductivity. In order to produce an electrically-conductive polymer, it is important to disperse an electrically-conductive carbon black into a base polymer without breaking the "structure".

A composite material containing electrically-conductive carbon black is considered to exhibit electrical conductivity through contact or tunnel effect between carbon black chains, whereby probably the former dominates. The longer the carbon black chains and the higher the density of carbon black in a polymer, the higher the electrical conductivity due to the high probability of carbon black particles to come in contact with one another. The present inventors found that the electrical conductivity due to electrically-conductive carbon black is very small if the content is less than 15 wt %, but it remarkably increases as the content increases to 20 wt % and levels off as the content exceeds 30 wt %.

Preferably, the electrically-conductive composite fiber of the present invention is composed of the electrically-conductive layer (A) and the protective layer (B) in a specific ratio. Preferably, (A) accounts for 3 wt % or more and (B) accounts for 97 wt % or less. Otherwise, the resulting composite fiber lacks stable structure for spinning.

In addition, in the case where the composite fiber has a plurality of cores, the cores are discontinuous in the longitudinal direction. If the electrically-conductive layer (A) accounts for more than 50 wt %, the resulting composite fiber has poor spinnability and drawability even if the protective polymer layer (B) has good fiber-forming properties.

Electrically-conductive carbon black impairs the spinnability of the electrically-conductive layer (A). If the electrically-conductive layer (A) has poor spinnability and accounts for more than half of the fiber, the resulting composite fiber has poor spinnability as well.

For this reason, the ratio of the electrically-conductive polymer layer (A) to the protective polymer layer (B), (A):(B), ranges preferably from 3:97 to 50:50, and more preferably 7:93 to 35:65 by weight. The ratio (A):(B) includes all values and subvalues therebetween, especially including 10:90; 15:85; 20:80; 25:75; 30:70; 35:65; 40:60 and 45:55 by weight.

It is preferred, according to the present invention, that the electrically-conductive composite fiber is constructed such that the electrically-conductive polymer layer (A) is partly exposed at the fiber surface at three or more places along the periphery of an arbitrary cross section of the fiber. Preferably, the number of such places is not more than 10, preferably between 4 to 8.

In addition, it is preferred that the electrically-conductive polymer layer (A) is exposed to such an extent that the length $L_1$ of one exposed part is not smaller than 0.1 $\mu$m and not larger than $L_2/10$ measured in the circumferential direction of the fiber cross section, where $L_2$ is the length (in $\mu$m) of the periphery of the cross section of the composite fiber.

In the case that the length ($L_1$) is smaller than 0.1 $\mu$m even though the number of exposed parts is 3 or more, or in the case that the number of exposed parts is less than 3, the composite fiber does not produce stable conductivity because of the low probability of the electrically-conductive polymer coming into contact with an object contacting the composite fiber. In contrast, if the length ($L_1$) exceeds ($L_2/10$), then there are difficulties in the spinning process and the composite fiber exhibits poor wear resistance. Moreover, the electrically-conductive polymer layer (A) and the protective polymer layer (B) peel easily from each other, and have poor electrical conductivity.

According to the present invention, it is preferred that the protective polymer layer (B) has a length which accounts for no less than 60%, preferably no less than 70%, more preferably not more than 80% and most preferably not more than 90% of the length of the periphery of the fiber cross section. Otherwise, the composite fiber has poor spinnability and strength. The length of the protective polymer layer (B) includes all values and subvalues therebetween, especially including no less than 65, 70, 75, 80 and 85% of the length of the periphery of the fiber cross section.

The protective polymer layer (B) is important for the composite fiber to exhibit good spinnability, good fiber properties, and good durability. The protective polymer layer (B) is formed from a fiber-forming thermoplastic polyamide having a melting point not lower than 170° C. Preferably, this thermoplastic polyamide is composed of a dicarboxylic acid component and a diamine component. In the dicarboxylic acid component an aromatic dicarboxylic acid can account for no less than 60 mol %. In the diamine component a $C_{6-12}$ aliphatic alkylenediamine can account for no less than 60 mol %. This polyamide is characterized by its good heat resistance, particularly under wet heat condition, good spinnability and ability to yield a fiber having high strength and good color fastness.

A preferred example of the aromatic dicarboxylic acid is terephthalic acid, which is desirable particularly from the standpoint of heat resistance. Other preferred examples include isophthalic acid, 2,6-naphthalenedicarboxylic acid, 2,7-naphthalenedicarboxylic acid, 1,4-naphthalenedicarboxylic acid, 1,4-phenylenedioxydiacetic acid, 1,3-phenylenedioxydiacetic acid, diphenic acid, dibenzoic acid, 4,4'-oxydibenzoic acid, diphenylmethane-4,4'-dicarboxylic acid, diphenylsulfone-4,4'-dicarboxylic acid, and 4,4'-biphenyldicarboxylic acid. They may be used alone or in combination with one another. The content of the aromatic dicarboxylic acid in the dicarboxylic acid component is preferably no less than 60 mol %, more preferably no less than 75 mol % based on the total amount of dicarboxylic acid component. The content of the aromatic dicarboxylic acid in the dicarboxylic acid component includes all values and subvalues therebetween, especially including no less than 62, 64, 66, 68, 70, 72 and 74 mol % based on the total amount of the dicarboxylic acid component.

Further, preferred examples of dicarboxylic acids include aliphatic dicarboxylic acids, such as malonic acid, dimethylmalonic acid, succinic acid, 3,3-diethylsuccinic acid, glutaric acid, 2,2-dimethylglutaric acid, adipic acid, 2-methyladipic acid, trimethyladipic acid, pimelic acid, azelaic acid, sebacic acid, and suberic acid; and alicyclic dicarboxylic acids, such as 1,3-cyclopentanedicarboxylic acid and 1,4-cyclohexanedicarboxylic acid. They may be used alone or in combination with one another.

In addition, above dicarboxylic acids may be used in combination with a polycarboxylic acid, such as trimellitic acid, trimesic acid, and pyromellitic acid, in an amount that does not decrease the spinnability.

According to the present invention, the content of the aromatic dicarboxylic acid in the dicarboxylic acid component is preferably 100% from the standpoint of heat resistance and fiber properties.

Preferably, no less than 60 mol % of the diamine component is a $C_{6-12}$ aliphatic alkylenediamine. Preferred examples of such aliphatic alkylenediamines include 1,6-hexanediamine, 1,8-octanediamine, 1,9-nonanediamine, 1,10-decanediamine, 1,11-undecanediamine, 1,12-dodecanediamine, 2-methyl-1,5-pentanediamine, 3-methyl-1,5-pentanediamine, 2,2,4-trimethyl-1,6-hexanediamine, 2,4,4-trimethyl-1,6-hexanediamine, 2-methyl-1,8-octanediamine, and 5-methyl-1,9-nonanediamine. Of these examples, 1,9-nonanediamine is preferable from the standpoint of heat resistance and fiber properties. It may be used in combination with 2-methyl-1,8-octanediamine.

The content of the aliphatic alkylenediamine in the diamine component is preferably no less than 60 mol %, more preferably no less than 75%, most preferably no less than 90 mol % based on the total amount of the diamine component. The content of aliphatic alkylenediamine in the diamine component includes all values and subvalues therebetween, especially including no less than 65, 70, 75, 80, and 85 mol %.

Further preferred examples of diamines include aliphatic diamines, such as ethylenediamine, propylenediamine, and 1,4-butanediamine; alicyclic diamines, such as cyclohexanediamine, methylcyclohexanediamine, isophoronediamine, norbornanedimethyldiamine, and tricyclodecanedimethylamine; and aromatic diamines, such as p-phenylenediamine, m-phenylenediamine, xylylenediamine, 4,4'-diaminodiphenylmethane, 4,4'-diaminodiphenylsulfone, and 4,4'-diaminodiphenylether. They may be used alone or in combination with one another.

In the case where 1,9-nonanediamine and 2-methyl-1,8-octanediamine are used in combination as the aliphatic alkylenediamine, their total amount is preferably 60–100 mol % of the diamine component. The molar ratio of the 1,9-nonanediamine to the 2-methyl-1,8-octanediamine is preferably 30:70 to 99:1, and more preferably 40:60 to 95:5. The molar ratio of 1,9-nonanediamine to 2-methyl-1,8-octanediamine includes all values and subvalues therebetween, especially including 35:65; 40:60; 45:55; 50:50; 55:45; 60:40; 65:35; 70:30; 75:25; 80:20; 85:15; 90:10 and 95:5.

The polyamide used in the present invention preferably has a molecular chain containing CONH units and $CH_2$ units in a ratio of 1:2 to 1:8, particularly preferable 1:3 to 1:5.

The above-mentioned polyamide preferably has an intrinsic viscosity of 0.6–2.0 dl/g, more preferably 0.6–1.8 dl/g, and most preferably 0.7–1.6 dl/g (measured at 30° C. in conc. sulfuric acid), so that it has a melt viscosity suitable for spinning and gives fibers having good properties and good heat resistance.

In addition, the above-mentioned polyamide preferably has molecular chains whose terminal groups are partly blocked by a blocking agent. The amount of blocked terminal groups preferably is no less than 10%, more preferably no less than 40%, and most preferably no less than 70% based on the total amount of the terminal groups. The amount of blocked terminal groups includes all values and subvalues therebetween, especially including no less than 20, 30, 40, 50, and 60% based on the total amount of the terminal groups.

The above-mentioned polyamide may be produced by any known method applicable to crystalline polyamides. Examples of such methods include solution polymerization or interfacial polymerization which starts with an acid chloride and a diamine, and melt polymerization or solid phase polymerization which starts with a dicarboxylic acid or an alkyl ester thereof and a diamine.

The above-mentioned polyamide adheres well to the electrically-conductive polymer layer (A) which is one of the important constituents in the present invention. In addition, it is immune to interfacial peeling and is preferred from the standpoint of heat resistance and fiber properties.

According to the present invention, the electrically-conductive polymer layer (A) is formed from the following polymer.

According to the present invention, it is important to use a thermoplastic polyamide to form the electrically-conductive polymer layer (A). Examples of a thermoplastic polyamide include nylon-12, nylon-11, nylon-6, nylon-66, and nylon elastomer. They may be replaced by the above polyamide forming the protective layer (B).

Electrically-conductive fiber is usually used in the form of working wear for work in an environment where static build-up causes explosion or in charging brushes for copying machines. Repeated bending, stretching, and rubbing during their prolonged use cause damage to the electrically-conductive layer, such as cracking, thereby deteriorating the destaticizing performance. There is no way to recover such damage, and it is necessary to replace damaged items in a short period of time.

The present inventors investigated the dispersion of electrically-conductive carbon black into a variety of polymers. It was found that polyamides having polar groups are highly compatible with electrically-conductive carbon black and retain their high fluidity even after incorporation of a large amount of electrically-conductive carbon black. In other words, polyamides can be a basis for compounds having good electrical conductivity and good fluidity. Such compounds are also superior in mechanical properties because of good adhesion between polyamide and electrically-conductive carbon black.

However, the foregoing is true only for polyamides. For example, polyesters rapidly increase in viscosity and loose fluidity when electrically-conductive carbon black is incorporated, even if the mixing ratio is low. In other words, polyesters cannot be a basis for an electrically-conductive polymer that has the desired electrical-conductivity and desired spinnability. Polyesters are not competitive with polyamide resins.

As compared with polyesters, polyolefins retain slightly better fluidity even after incorporation of electrically-conductive carbon black and hence can be a basis for electrically-conductive polymers. Unfortunately, the resulting compounds are much poorer in mechanical properties than the polyamides because polyolefins adhere poorly to electrically-conductive carbon black. Therefore, polyolefins have drawbacks such as breakage of the electrically-conductive polymer layer during processing into a composite fiber.

It is concluded from the foregoing that thermoplastic polyamides are most suitable as polymers for electrically-conductive polymer layers containing electrically-conductive carbon black.

According to the present invention, the electrically-conductive composite fiber preferably has an electrical resistance R (Ω/cm·f) which can be varied depending on applications. If the electrically-conductive composite fiber is to be used for garments or charging brushes, it is preferred to have an electrical resistance R (Ω/cm·f), at an applied voltage of 100V, wherein log R is from 7.0 to 11.9

For charging brushes a value of R (Ω/cm·f) is preferably such that log R is from 8.5 to 11.5.

To meet requirements for such electrical resistance characteristics in the present invention, it is desirable to use two kinds of electrically-conductive carbon black which differ in oil absorption in combination. A first electrically-conductive carbon black preferably has an oil absorption of 130–350 cc/100 g, and a second electrically-conductive carbon black preferably has an oil absorption of 15–130 cc/100 g. The ratio of the carbon black having high oil absorption to the one having lower oil absorption is preferably from 1.2 to 25. The oil absorption is determined by measuring the maximum amount (in cc) of linseed oil absorbed by 100 g of carbon black.

The above-mentioned two kinds of electrically-conductive carbon black differ also in resistivity. The carbon black having high oil absorption preferably has a resistivity of $10^{-3}$–$10^{2}$ Ω·cm and the one having lower oil absorption preferably has a resistivity of $10^{0}$–$10^{6}$ Ω·cm.

The mixing ratio of the carbon black having high oil absorption to the one having lower oil absorption is preferably from 10:1 to 1:10, so that the resulting mixture exhibits the desired conductivity. The mixing ratio includes all values and subvalues therebetween, especially including 9:2; 8:3; 7:4; 6:5; 5:6; 4:7; 3:8 and 2:9.

The method of producing the electrically-conductive composite fiber of the present invention is not specifically restricted. For example, it may be produced by melt-spinning and ensuing drawing with an apparatus for a multicore-sheath composite fiber. Ordinary melt-spinning may be replaced by high-speed spinning which obviates the necessity of drawing. In the process of melt-spinning, it is important to adjust the relative positions of the inlets for the electrically-conductive polymer and the protective polymer so that the electrically-conductive polymer layer (A) is exposed at the fiber surface as desired and the ratio of the two polymers is adequately controlled.

For improved drawability of the electrically-conductive composite fiber, it is preferred to incorporate not more than 5 wt % of inorganic fine powder having an average particle diameter not larger than 0.5 μm into the protective layer (B).

The monofilament fineness of the electrically-conductive composite fiber produced in the above-mentioned manner is not specifically restricted. Common fineness ranges from 2 to 34 dtex. The finess includes all values and subvalues therebetween, especially including 5, 10, 15, 20, 25 and 30 dtex.

According to the present invention, the electrically-conductive layer (A) is partly exposed at the fiber surface so that it is conducting at a low voltage generated by friction. This effect is achieved only when the electrically-conductive polymer layer (A) is combined with the protective polymer layer (B) as specified above.

The cross section of the composite fiber of the present invention is not specifically restricted provided the electrically-conductive polymer layer (A) is exposed as described above. Examples of the cross section are shown in FIGS. 1 to 8. A cross section shown in FIG. 3 is most preferable because the four core components are arranged at equal intervals along the periphery of the cross section and each-core component is exposed at the fiber surface.

The electrically-conductive composite fiber according to the present invention will find use as a charging brush or a destaticizing brush for copying machines and printers because of its long-lasting good destaticizing performance as well as its good fiber characteristics. It will also find use as a garment, for example, working wear and uniforms, due to its good color fastness and to avoid static electrification.

Having generally described this invention, a further understanding can be obtained by reference to certain specific examples which are provided herein for purposes of illustration only, and are not intended to be limiting unless otherwise specified.

EXAMPLES

Characteristic properties of each sample were measured in the following manner:

Electrical Resistance R

A sample of the electrically-conductive composite fiber (monofilament) was held between parallel clip electrodes. A DC voltage of 25–500V was applied to the sample, and a current flowing through the sample was measured with a volta meter. The electrical resistance of the sample was calculated according to Ohm's law from the voltage and the current at that voltage. The electrical resistance specified in the present invention was one which was measured at 100V.

Amount of Charge

A sample was rubbed with a fabric of acrylic fiber at 20° C. and 40% RH, and the amount of charge generated was measured with a simple Faraday gauge conforming to JIS L1094.

Color Fastness to Washing

A specimen (measuring 100×40 mm) was cut out of the fabric dyed under the condition shown in Example 1. Two pieces of nylon cloth (measuring 50×40 mm) were sewn side by side to the surface of the specimen. The specimen was washed according to JIS L0844–1997, Method A-2.

(1) Liquid soiling was judged according to JIS L0801–9 by observing the liquid which has been placed in a porcelain beaker (2×4×1 cm) that remain after washing.

(2) Soiling of the nylon cloth was judged according to JIS L0801-9.

Evaluation of Printed Images

A copying machine with DC bias voltage was run, with a charging brush under test turning in the direction opposite to that of the photoreceptor. Printed images were evaluated after initial runs and continued runs (10,000 copies). Criteria for evaluation were as follows.

(1) Evaluation after initial runs.

○: Images are uniform and clear.

Δ: Images have some traces due to anomalous discharge.

X: Images are blurred, with apparent streaky marks.

(2) Evaluation after continued runs.

○: Images are as uniform and clear as those after initial runs.

Δ: Images have some traces due to anomalous discharge.

X: Images are blurred, with apparent streaky marks.

Reference Examples 1 and 2

(Preparation of Thermoplastic Polyamide)

The following raw materials were placed in a 20-liter autoclave.

Terephthalic acid: 19.5 mol 1,9-nonanediamine: 10.0 mol 2-methyl-1,8-octanediamine: 10.0 mol Benzoic acid: 1.0 mol Sodium hypophosphite monohydrate: 0.06 mol (0.1 wt % of raw materials)

Distilled water: 2.2 liters

The atmosphere in the autoclave was replaced with nitrogen. The content of the autoclave was stirred at 100° C. for 30 minutes, and then the temperature in the autoclave was raised to 210° C. over 2 hours and the pressure in the autoclave was raised to 22 kg/cm$^2$ (2.16×10$^6$ Pa) in the same period. Reaction was continued for 1 hour at this temperature and pressure. The temperature was raised to 230° C. and this temperature was maintained for 2 hours. Reaction was continued at a constant pressure of 22 kg/cm$^2$ (2.16×10$^6$ Pa), which was maintained by discharging steam from the autoclave. The pressure was reduced to 10 kg/cm$^2$ (9.81×10$^5$ Pa) over 30 minutes. Reaction was continued for 1 hour at this pressure. Thus there was obtained a prepolymer. This prepolymer was dried at 100° C. for 12 hours under reduced pressure. The resulting product was crushed into particles smaller than 2 mm.

The crushed product underwent solid phase polymerization at 230° C. and 0.1 mmHg (13.3 Pa) for 10 hours. Thus there was obtained a desired polyamide, which has an intrinsic viscosity of 0.9 and a CONH/CH$_2$ ratio of 1/3.9, as shown in Table 1.

TABLE 1

| | | Referential Example 1 PA9MT | Referential Example 2 PA9T |
|---|---|---|---|
| Composition | Terephthalic acid (mol)_ | 19.5 | 19.4 |
| | 1,9-nonanediamine (mol) | 10.0 | 20.0 |
| | 2-methyl-1,8-octanediamine (mol) | 10.0 | — |
| | Benzoic acid (mol) | 1.0 | 1.2 |
| NaH PO H O (mol) | | 0.06 | 0.06 |
| Intrinsic viscosity | | 0.9 | 0.8 |
| CONH/CH ratio | | 1/3.9 | 1/4.5 |

Example 1

This example demonstrates the performance of an electrically-conductive composite fiber composed of an electrically-conductive polymer component (A) and a protective polymer component (B). Component (A) is nylon-6 containing 35 wt % of electrically-conductive carbon black (with oil absorption of 115 cc/100 g). Component (B) is the thermoplastic polyamide (PA9MT) obtained in Referential Example 1, whose properties are shown in Table 1. The components A and B in a ratio of 13/87 by weight were spun into a composite fiber of core-sheath type having the cross section as shown in FIG. 3. (This composite fiber has four cores which expose themselves at the fiber surface.) Spinning was followed by drawing. Thus there was obtained the desired electrically-conductive composite fiber having a fineness of 25 denier/4 f (27.8 dtex/4 f) and also having $L_2$=88 $\mu$m, which is the length of the periphery of the cross section of one filament. There was no problem in the spinning process. The thus obtained electrically-conductive composite fiber has the electrically-conductive layer (A) which is uniformly continuous in the fiber axial direction. The electrically-conductive layer (A) exposes itself at four places in the fiber surface. The length ($L_1$) of each exposed part is 0.6 $\mu$m in the peripheral direction of the cross section of the fiber. In other words, the composite fiber has $L_1$ and $L_2$ which satisfy the condition $0.1 \leqq L_1 < L_2/10$. In addition, the composite fiber invariably has an electrical resistance of $2\times10^8$ Ω/cm·f (log R=8.3) at 100V. It exhibits good electrical conductivity at a low voltage applied.

The thus obtained composite fiber was covered with polyester/cotton (65/35) blended yarn. A 2/1 twill (80 warps/inch and 50 wefts/inch) was woven from polyester/cotton (65/35) blended yarn having a cotton yarn number of 20S/2, one pick per 80 warps being the covered yarn mentioned above. The polyester and cotton in the twill were dyed sequentially in the following manner.

(1) Dyeing of Polyester

Dyeing

| | | |
|---|---|---|
| Disperse dye: | Dianix Blue BG-FS | 3% omf |
| Dispersant: | Disper TL | 1 g/L |
| | Acetic acid (50%) | 0.5 cc/L |
| Bath ratio: | 1:50 | |

Dyeing temperature×time: 130° C.×40 minutes

Reduction Clearing

| | |
|---|---|
| Hydrosulfite | 1 g/L |
| NaOH | 1 g/L |
| Amiladine D | 1 g/L |

Reduction clearing was followed by cold water washing.

(2) Dyeing of Cotton

Dyeing

| | | |
|---|---|---|
| Reactive dye: | Sumifix Supra BRF 150% gran: | 2% omf |
| | Sodium sulfate: | 40 g/L |
| Bath ratio: | 1:50 | |

The fabric is kept in the bath at 30° C. for 20 minutes. Then the bath temperature is raised to 70° C. over 20 minutes. After standing at 70° C. for 20 minutes, the bath is given $Na_2CO_3$ (20 g/L). Dyeing is carried out for 20 minutes. Soaping with Marseilles soap (2 g/L) and $Na_2CO_3$ (2 g/L) is carried out at 90° C. for 20 minutes. Dyeing is completed by cold water washing.

The fabric was found to have a charge of 3.5 $\mu$C/m$^2$. After actual wearing for 2 years and repeated washing (about 250 times), the fabric had a charge of 4.8 $\mu$C/m$^2$. This indicates that the fabric has good destaticizing performance and good durability. See Tables 2 and 3. It meets the requirement for the standard value (lower than 7 $\mu$C/m$^2$) in "Recommended Practice for Protection Against Hazards Arising out of Static Electricity in General Industries" issued by Technology Institute of Industrial Safety.

TABLE 2

| | Electrically-conductive polymer layer (A) | | | | | Protective polymer layer (b) | | | |
|---|---|---|---|---|---|---|---|---|---|
| | Electrically-conductive carbon blacks (α and β) | | | | Carbon | | | Amount | Ratio of |
| | Oil absorption of α (cc/100 g) | Oil absorption of β (cc/100 g) | Mixing Ratio (α/β) | Matrix polymer | black (wt %) | Matrix polymer | Fine Powder | added (wt %) | A/B (wt %) |
| Example 1 | 115 | — | — | Nylon-6 | 35 | PA9MT | $TiO_2$ | 0.5 | 13/87 |
| Example 2 | 115 | — | — | Nylon-6 | 35 | PA9T | $TiO_2$ | 0.5 | 13/87 |
| Example 3 | 115 | — | — | Nylon-6 | 35 | PA9MT | $TiO_2$ | 0.5 | 13/87 |
| Example 4 | 115 | — | — | Nylon-6 | 35 | PA9MT | $TiO_2$ | 0.5 | 10/90 |
| Example 5 | 115 | — | — | Nylon-6 | 35 | PA9MT | $TiO_2$ | 0.5 | 25/75 |
| Example 6 | 115 | — | — | Nylon-6 | 35 | PA9MT | $TiO_2$ | 0.5 | 13/87 |
| Example 7 | 115 | — | — | Nylon-6 | 35 | PA9MT | $TiO_2$ | 0.5 | 13/87 |
| Example 8 | 115 | — | — | Nylon-6 | 35 | PA9MT | $TiO_2$ | 0.5 | 13/87 |
| Example 9 | 115 | — | — | Nylon-6 | 35 | PA9MT | $SiO_2$ | 0.5 | 13/87 |
| Example 10 | 115 | — | — | Nylon-12 | 35 | PA9MT | $TiO_2$ | 0.5 | 13/87 |
| Example 11 | 180 | 80 | 2/1 | Nylon-6 | 35 | PA9MT | — | — | 13/87 |
| Example 12 | 180 | 40 | 1/1 | Nylon-6 | 40 | PA9MT | $TiO_2$ | 0.5 | 13/87 |
| Example 13 | 180 | 40* | 1/2 | Nylon-6 | 40 | PA9MT | $TiO_2$ | 0.5 | 13/87 |
| Example 14 | 115 | 40* | 1/2 | Nylon-6 | 40 | PA9MT | $TiO_2$ | 0.5 | 13/87 |
| Comp. Ex. 1 | 115 | — | — | Polyethylene | 35 | PA9MT | $TiO_2$ | 0.5 | 13/87 |
| Comp. Ex. 2 | 115 | — | — | Polyester | 25 | PA9MT | $TiO_2$ | 0.5 | 13/87 |
| Comp. Ex. 3 | 115 | — | — | Nylon-6 | 35 | PA9MT | $TiO_2$ | 0.5 | 25/75 |
| Comp. Ex. 4 | 115 | — | — | Nylon-6 | 35 | PA9MT | $TiO_2$ | 0.5 | 50/50 |

TABLE 2-continued

| | Electrically-conductive polymer layer (A) | | | | | Protective polymer layer (b) | | | |
|---|---|---|---|---|---|---|---|---|---|
| | Electrically-conductive carbon blacks (α and β) | | | | Carbon | | | Amount | Ratio of |
| | Oil absorption of α (cc/100 g) | Oil absorption of β (cc/100 g) | Mixing Ratio (α/β) | Matrix polymer | black (wt %) | Matrix polymer | Fine Powder | added (wt %) | A/B (wt %) |
| Comp. Ex. 5 | 180 | 40 | 1/1 | Nylon-6 | 40 | PA9MT | $TiO_2$ | 0.5 | 13/87 |
| Comp. Ex. 6 | — | 40 | — | Nylon-6 | 40 | PA9MT | $TiO_2$ | 0.5 | 13/87 |
| Comp. Ex. 7 | 115 | — | — | Nylon-6 | 35 | Nylon-6 | — | — | 13/87 |

* Insulating carbon black.

TABLE 3

Figure 2:
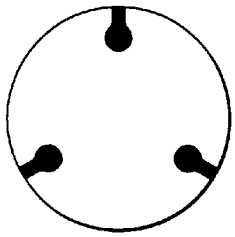
FIG. 2 is a sectional view showing a second configuration of the electrically-conductive composite fiber according to the present invention.
Figure 3:
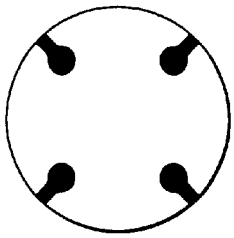
FIG. 3 is a sectional view showing a third configuration of the electrically-conductive composite fiber according to the present invention.
Figure 4:
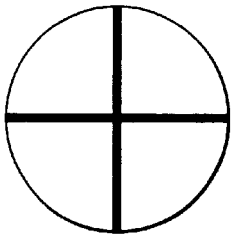
FIG. 4 is a sectional view showing a fourth configuration of the electrically-conductive composite fiber according to the present invention.
Figure 5:
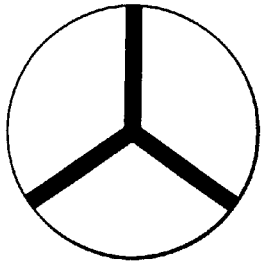
FIG. 5 is a sectional view showing a fifth configuration of the electrically-conductive composite fiber according to the present invention.
Figure 6:
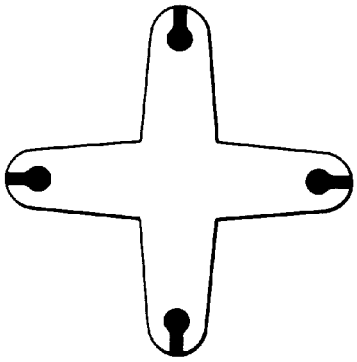
FIG. 6 is a sectional view showing a sixth configuration of the electrically-conductive composite fiber according to the present invention.
Figure 7:
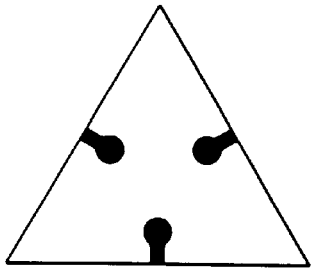
FIG. 7 is a sectional view showing a seventh configuration of the electrically-conductive composite fiber according to the present invention.
Figure 8:
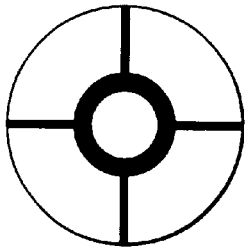
FIG. 8 is a sectional view showing an eighth configuration of the electrically-conductive composite fiber according to the present invention.
Figure 9:
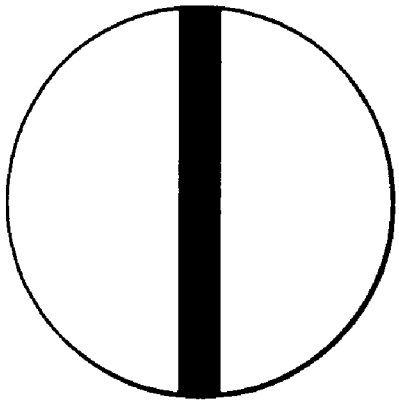
FIG. 9 is a sectional view showing a configuration of the electrically-conductive composite fiber in Comparative Example 3.
Figure 10:
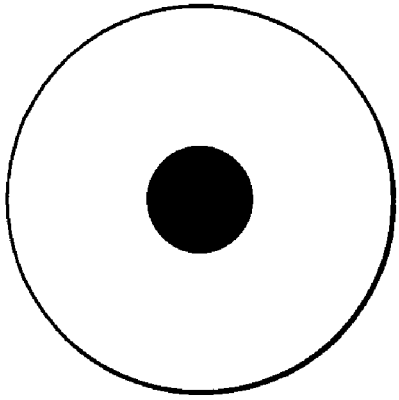
FIG. 10 is a sectional view showing a configuration of the electrically-conductive composite fiber in Comparative Example 4.

| | | | | | | | Destaticizing performance of fabric | | Evaluation of images | | Color fastness (class) | | |
|---|---|---|---|---|---|---|---|---|---|---|---|---|---|
| | | | | | | | Charge | | | Images | | | |
| | Cross section | Number of exposed parts | Length of exposed parts $L_1$ (μm) | Length of periphery of cross section $L_2$ (μm) | Electrical resistance R (Ω/cm · f) | log R | Initial charge (μC/m²) | after 2 years* (μC/m²) | Initial images | after 10,000 runs | Soiling of liquid | Soiling of fabric | Spinn-abililty |
| Example 1 | FIG. 3 | 4 | 0.6 | 88 | $2 \times 10^8$ | 8.3 | 3.5 | 4.8 | — | — | 4–5 | 4–5 | ⊙ |
| Example 2 | FIG. 3 | 4 | 0.6 | 88 | $3 \times 10^8$ | 8.5 | 3.3 | 4.5 | — | — | 5 | 5 | ⊙ |
| Example 3 | FIG. 3 | 4 | 1.5 | 88 | $2 \times 10^8$ | 8.3 | 3.5 | 4.7 | — | — | 4–5 | 4–5 | ⊙ |
| Example 4 | FIG. 3 | 4 | 0.2 | 88 | $2 \times 10^8$ | 8.3 | 3.4 | 4.8 | — | — | 4–5 | 4–5 | ⊙ |
| Example 5 | FIG. 3 | 4 | 3.5 | 88 | $2 \times 10^8$ | 8.3 | 3.7 | 5.1 | — | — | 4–5 | 4–5 | ○–⊙ |
| Example 6 | FIG. 1 | 4 | 1.0 | 102 | $3 \times 10^8$ | 8.5 | 3.5 | 4.7 | — | — | 4–5 | 4–5 | ○–⊙ |
| Example 7 | FIG. 6 | 4 | 0.3 | 117 | $5 \times 10^8$ | 8.7 | 3.1 | 4.3 | — | — | 4–5 | 4–5 | ○–⊙ |
| Example 8 | FIG. 2 | 3 | 0.6 | 88 | $2 \times 10^8$ | 8.3 | 3.4 | 4.6 | — | — | 4–5 | 4–5 | ⊙ |
| Example 9 | FIG. 3 | 4 | 0.6 | 88 | $2 \times 10^8$ | 8.3 | 3.6 | 4.9 | — | — | 4–5 | 4–5 | ⊙ |
| Example 10 | FIG. 3 | 4 | 2.0 | 88 | $1 \times 10^8$ | 8.0 | 4.0 | 5.2 | — | — | 4–5 | 4–5 | ⊙ |
| Example 11 | FIG. 3 | 4 | 0.6 | 88 | $1 \times 10^9$ | 9.0 | — | — | ○–⊙ | ○–⊙ | — | — | ○–⊙ |
| Example 12 | FIG. 3 | 4 | 0.6 | 88 | $2 \times 10^{10}$ | 10.3 | — | — | ⊙ | ○–⊙ | — | — | ○–⊙ |
| Example 13 | FIG. 3 | 4 | 0.6 | 88 | $7 \times 10^{10}$ | 10.8 | — | — | ⊙ | ○–⊙ | — | — | ○–⊙ |
| Example 14 | FIG. 3 | 4 | 0.6 | 88 | $2 \times 10^{11}$ | 11.3 | — | — | ○–⊙ | ○–⊙ | — | — | ○–⊙ |
| Comp. Ex. 1 | FIG. 3 | 4 | 0.8 | 90 | $9 \times 10^7$ | 7.9 | 3.7 | 11.0 | — | — | 4–5 | 4–5 | ⊙ |
| Comp. Ex. 2 | FIG. 3 | 4 | 0.6 | 85 | — | — | — | — | — | — | — | — | x |
| Comp. Ex. 3 | FIG. 3 | 4 | 9.0 | 88 | $2 \times 10^8$ | 8.3 | 6.5 | 10.5 | — | — | 4–5 | 4–5 | Δ–x |
| Comp. Ex. 4 | FIG. 3 | 4 | 0.6 | 88 | — | — | — | — | — | — | — | — | x |
| Comp. Ex. 5 | FIG. 10 | 0 | — | — | $7 \times 10^{12}$ | 12.8 | — | — | Δ–x | x | — | — | ○–⊙ |
| Comp. Ex. 6 | FIG. 3 | 4 | 0.6 | 88 | $4 \times 10^{12}$ | 12.6 | — | — | x | x | — | — | ○–⊙ |
| Comp. Ex. 7 | FIG. 3 | 4 | 0.6 | 88 | $3 \times 10^8$ | 8.5 | 3.7 | 6.2 | — | — | 1–2 | 1–2 | ○–⊙ |

*After 250 washings

Example 2

The same procedure as in Example 1 was repeated except that the protective polymer component (B) was replaced by the thermoplastic polyamide (PA9T) in Table 2 which was prepared in Referential Example 2. This polymer exhibited good spinnability and the resulting fabric also exhibited good destaticizing performance and good durability, with the amount of charge (initial and after 250 washings) meeting requirements for standard values. See Tables 2 and 3.

Examples 3 to 5

The same procedure as in Example 1 was repeated except that the ratio (A/B) and/or the length of exposed part were changed as shown in Tables 2 and 3. The polymer exhibited good spinnability and the resulting fabric also exhibited good destaticizing performance and good durability, with the amount of charge (initial and after 250 washings) meeting requirements for standard values. See Tables 2 and 3.

Examples 6 to 8

The same procedure as in Example 1 was repeated except that the cross section of the fiber was changed to those shown in FIG. 1 (Example 6), FIG. 6 (Example 7), and FIG. 2 (Example 8). The polymer exhibited good spinnability and the resulting fabric also exhibited good destaticizing performance and good durability, with the amount of charge (initial and after 250 washings) meeting requirements for standard values. See Tables 2 and 3.

Examples 9 and 10

The same procedure as in Example 1 was repeated except that the protective polymer layer was incorporated with 2.0 wt % of $SiO_2$ fine powder (in Example 9) or the electrically-conductive matrix polymer was replaced by nylon-12 (in Example 10). The polymer exhibited good spinnability and the resulting fabric also exhibited good destaticizing performance and good durability, with the amount of charge (initial and after 250 washings) meeting requirements for standard values. See Tables 2 and 3.

Comparative Examples 1 to 4

Electrically-conductive composite fibers as shown in Tables 2 and 3 were prepared in the same way as in Example 1. They were poor in durability of destaticizing performance and spinnability. See Tables 2 and 3.

Example 11

The same procedure as in Example 1 was repeated except that the electrically-conductive polymer component (A) was replaced by nylon-6 incorporated with 35 wt % of two kinds of electrically-conductive carbon blacks differing in electrical conductivity (one having an oil absorption of 180 cc/100 g and the other having an oil absorption of 80 cc/100 g, with the mixing ratio of the former to the latter being 2/1). There was obtained electrically-conductive composite fiber having a fineness of 25 denier/4 f (27.8 dtex/4 f), with $L_2$ being 88 $\mu$m (length of periphery of cross section of one filament). The polymer was good in spinnability. The resulting electrically-conductive composite fiber has the electrically-conductive polymer layer (A) which is continuous in the direction of the fiber axis. The electrically-conductive polymer layer (A) exposed itself at the fiber surface and the number of exposed parts was four. The length ($L_1$) of each exposed part was 0.6 $\mu$m. Thus the composite fiber meets the condition of $0.1 \leqq L_1 \leqq L_2/10$. In addition, the composite fiber had an electrical resistance of $1\times10^9$ $\Omega$/cm·f (or log R=9.0) at 100V. In other words, it has good conductivity at a low applied voltage.

The thus obtained electrically-conductive composite fiber was made into a pile fabric having a density of 50,000 fibers/in$^2$. This pile fabric was used as a conductive brush for a copying machine. It gave good printed images free of traces due to anomalous discharge. It exhibited good durability and gave good printed images even after 10,000 runs. Refer to Tables 2 and 3 for composition, fiber form, spinnability, electrical resistance, and image evaluation.

Examples 12 to 14

The same procedure as in Example 11 was repeated except that changes were made in the kind of carbon black, the mixing ratio of carbon black, and the amount of carbon black added to the matrix polymer. The resulting polymer was good in spinnability and the fabric made from the composite fiber gave good printed images. See Tables 2 and 3.

Comparative Examples 5 and 6

Samples of electrically-conductive composite fiber as shown in Table 2 were prepared. Charging brushes made from them gave poor printed images when evaluated in the same way as in Example 11.

Effect of the Invention

The present invention provides an electrically-conductive composite fiber which is formed in a specific way from a polyamide containing a specific amount of electrically-conductive carbon black and a thermoplastic polyamide of specific composition. The composite fiber finds use as garments and charging brushes for copying machines. It maintains good destaticizing performance even during prolonged use. In addition, the composite fiber exhibits good color fastness and causes no sweating when dyed together with another fiber.

The priority document of the present application, Japanese Patent Application No. 285464/1999, filed Oct. 6, 1999, is incorporated herein by reference in its entirety.

Obviously, numerous modifications and variations on the present invention are possible in light of the above teachings. It is therefore to be understood that within the scope of the appended claims, the invention may be practiced otherwise than as specifically described herein.

What is claimed is:

1. An electrically-conductive composite fiber, comprising:

an electrically-conductive polymer layer (A) of thermoplastic polyamide containing 15–50 wt % of electrically-conductive carbon black; and a protective polymer layer (B) of thermoplastic polyamide having a melting point not lower than 170° C.;

wherein said electrically-conductive polymer layer (A) is exposed at three or more places on a surface of said fiber along a periphery of an arbitrary cross section such that the length $L_1$ (in $\mu$m) of one exposed part satisfies expression (1)

$$0.1 \leqq L_1 L_2/10 \quad (1)$$

wherein $L_2$ stands for the length (in $\mu$m) of the periphery of a cross section of one filament;

wherein said protective polymer layer (B) covers no less than 60% of the periphery of the cross section of said fiber and accounts for 50–97 wt % of the total fiber weight; and wherein said thermoplastic polyamide constituting said protective polymer layer (B) is one which is synthesized from a dicarboxylic acid in which an aromatic dicarboxylic acid accounts for no less than 60 mol % and a diamine in which a $C_{6-12}$ aliphatic alkylenediamine accounts for no less than 60 mol %.

2. The electrically-conductive composite fiber according to claim 1, wherein the protective polymer layer (B) contains not more than 5 wt % of inorganic fine powder having an average particle diameter not larger than 0.5 $\mu$m.

3. The electrically-conductive composite fiber according to claim 1, wherein a number of said places on said surface is not more than 10.

4. The electrically-conductive composite fiber according to claim 1, wherein said electrically-conductive layer contains at least two electrically-conductive carbon blacks;

wherein a first electrically-conductive carbon black has a different value of oil absorption than a second electrically-conductive carbon black.

5. The electrically-conductive composite fiber according to claim 4, wherein said electrically-conductive layer has an electrical resistance R for an applied voltage of 100V; and wherein log R ranges from 7.0 to 11.9.

6. The electrically-conductive composite fiber according to claim 4, wherein said first electrically-conductive carbon black has an oil absorption of from 130 to 350 cc/100 g.

7. The electrically-conductive composite fiber according to claim 4, wherein said second electrically-conductive carbon black has an oil absorption of from 15 to 130 cc/100 g.

8. The electrically-conductive composite fiber according to claim 4, wherein a ratio of said oil absorption of said first electrically-conductive carbon black to said oil absorption of said second electrically-conductive carbon black is from 1.2 to 25.

* * * * *